United States Patent [19]

Merchant et al.

[11] Patent Number: 4,517,034

[45] Date of Patent: May 14, 1985

[54] STRIP CAST ALUMINUM ALLOY SUITABLE FOR CAN MAKING

[75] Inventors: Harish D. Merchant, Fairfield, Conn.; Edgar Lossack, Bonn, Fed. Rep. of Germany

[73] Assignee: Continental Can Company, Stamford, Conn.

[21] Appl. No.: 483,337

[22] Filed: Apr. 8, 1983

Related U.S. Application Data

[63] Continuation-in-part of Ser. No. 398,734, Jul. 15, 1982, abandoned.

[51] Int. Cl.[3] ..... C22F 1/04

[52] U.S. Cl. ..... 148/439; 148/2; 148/11.5 A; 148/440

[58] Field of Search ..... 148/2, 3, 11.5 A, 12.7 A, 148/159, 440, 439; 420/546

[56] References Cited

U.S. PATENT DOCUMENTS

| | | | |
|---|---|---|---|
| 3,318,738 | 5/1967 | Winter | 148/2 |
| 3,490,955 | 1/1970 | Winter et al. | 148/437 |
| 3,930,895 | 6/1976 | Moser et al. | 148/2 |
| 4,111,721 | 9/1978 | Hitchler et al. | 148/2 |
| 4,126,487 | 11/1978 | Morris et al. | 148/2 |
| 4,334,935 | 6/1982 | Morris | 148/2 |

*Primary Examiner*—L. Dewayne Rutledge
*Assistant Examiner*—Robert L. McDowell
*Attorney, Agent, or Firm*—Paul Shapiro

[57] ABSTRACT

A modified aluminum alloy 3004 composition comprising by weight 0.5–1.5% magnesium, 0.5–1.5% manganese, 0.1–1.0% iron, 0.1–0.5% silicon, 0.1–0.4% chromium, 0.0–0.25% zinc and 0.0 to 0.25% copper, the balance being aluminum. Webs of one inch or less in thickness formed from the alloy by continuous strip casting can be fabricated into non-galling, low earing can stock suitable for deep-drawing and ironing into high buckle strength two-piece beverage containers.

14 Claims, No Drawings

STRIP CAST ALUMINUM ALLOY SUITABLE FOR CAN MAKING

BACKGROUND OF THE INVENTION

1. Field of the Invention

This application is a continuation in part of U.S. Ser. No. 398,734 filed July 15, 1982 and now abandoned. The present invention is directed to a strip cast aluminum alloy suitable for use in the manufacture of deep drawn and wall-ironed articles such as cans and the like.

2. The Prior Art

In recent years, aluminum alloys such as the Aluminum Association specification 3004 have been successfully fabricated into two piece beverage cans by deep drawing and ironing. The expanding use of the two piece aluminum cans has created a need for aluminum alloy sheet for forming the can body that not only possesses the required combination of formability and strength properties but is also economical to manufacture.

Typically the aluminum alloy 3004 sheet useful in the production of deep drawn and ironed beverage cans is cast by direct chill casting an ingot having a thickness of about 20–25 inches. The ingot is homogenized at 950°–1125° F. for 4–24 hours and then subjected to hot rolling wherein the ingot is passed through a series of breakdown rolls maintained at a temperature of 400°–900° F. to reduce the ingot in thickness to a reroll gauge of about 0.130 inch.

Thereafter the reroll stock is subjected to an annealing step wherein the stock is heated at 600°–900° F. for 0.5–3.0 hours to effect recrystallization of the metal structure. The annealed reroll stock is subjected to a final work hardening step wherein the reroll stock is cold rolled (room temperature rolling) to a final gauge of about 0.013 inch or about 90% of its original thickness to produce the substantially full hard (H19) temper required for two-piece can body stock.

In spite of the successful use in can-making of direct chill ingot cast aluminum alloy 3004, economic and energy considerations would favor the manufacture of the aluminum sheet by continuous strip casting route. In this process, the molten aluminum is cast and solidified into a thin web of one inch or less in thickness so that subsequent rolling is reduced to a minimum and the costly step of hot rolling is eliminated.

In the manufacture of continuous strip cast aluminum alloy 3004 for can manufacture, the thin, e.g., 0.2–1.0 inch, solidified cast web is typically reduced in thickness to a gauge of about 0.008 to 0.017 inch and generally about 0.013 inch by cold rolling with an intermediate recrystallization anneal at about 600°–900° F. Thereafter, as in the manufacture of direct chill ingot cast stock, the thinned, annealed stock is subjected to a final work hardening step by cold rolling to a final gauge of about 0.013 inch to produce the H19 temper required for can body manufacture.

Although the continuous strip cast aluminum alloy 3004 is advantageously utilized for many fabricated products, such stock has not been used extensively for the manufacture of drawn and wall-ironed can bodies.

In the production of two-piece drawn and wall-ironed beverage cans, circular discs or blanks are cut or punched from the cold worked sheet for deep drawing into the desired shape. The blank is first drawn to approximately the final diameter cup. The sidewalls are then reduced in thickness in one or more wall-ironing operations.

Because of the nature of the working stresses incurred during wall-ironing of the deep drawn shell, when continuous strip cast aluminum alloy 3004 is subjected to wall-ironing, deep grooves may appear on the finish can which is referred to in the art as "galling". Galling adversely affects the acceptability of the can product and the effectiveness of the can manufacturing process. Galling is not normally observed during wall-ironing aluminum sheets of the same alloy composition produced from direct chill ingot casting.

A second problem encountered in the manufacture of deep drawn and wall-ironed containers from strip cast aluminum alloy is the problem of "earing". Earing manifests itself as a scalloped appearance around the top edge of the cup during the deep drawing cup formation step of the draw and wall-iron processing of the aluminum sheet.

The scallops, or ears, represent an almost universally undesirable feature of the cup as the ears must be removed in order to present a smooth or flat upper lip on the cup. This of course necessitates cup trimming prior or subsequent to wall-ironing, with an attendant increase in production costs and material waste.

The level of earing in a drawn cup is determined by the following equation:

$$\frac{he - ht}{(he + ht)/2} \times 100 = \%\ \text{Earing}$$

where he is the distance between the bottom of the cup and the peak of the ear and ht is the distance between the bottom of the cup and the valley of the ear.

To be acceptable for can making, the aluminum alloy sheet when processed into a cup must exhibit a level of earing of no more than about 3.5% and preferably less than about 3% earing. The level of earing experienced with commercially available continuously cast strip of aluminum alloy 3004 is generally in the range of 5% or more.

The art has addressed the problems encountered in the manufacture of deep drawn and wall-ironed cans from strip cast aluminum alloy without apparent success. Representative of this art is U.S. Pat. No. 3,834,900 assigned to the American Can Company which discloses a special strip cast, high strength aluminum alloy suitable for can making applications, e.g., can body or ends wherein the alloy is composed of about 2.8% magnesium, 0.65% iron and 0.25% each of silicon, copper and manganese, the balance being aluminum and incidental impurities. In a later patent to the same assignee, U.S. Pat. No. 4,111,721, the galling problem encountered with continuous strip cast aluminum sheet in the manufacture of container bodies using aluminum alloy 3004 is alleviated by heat soaking the cast strip at 900°–1150° F. for 16–24 hours. U.S. Pat. No. 3,930,895 discloses strip cast aluminum alloy 3004 suitable for the manufacture of can bodies which is modified ot have a high (1.6–3.0) manganese content. Sheet metal stock formed from a strip cast web of the modified alloy is homogenized at 950°–1050° F. to impart a gall-free character to the alloy sheet.

In U.S. application Ser. No. 398,735 entitled "Process for the Manufacture of Continuous Strip Cast Aluminum Alloy Suitable for Can Making", filed July 15, 1982, there is disclosed a process for the preparation of non-galling, low earing can stock from continuously cast aluminum strop suitable for deep drawing and wall-ironing into beverage containers wherein the molten aluminum material is cast by continuous strip casting into a web generally of an inch or less in thickness. The strip material is heated to a temperature of from 950° to 1150° F. for a time sufficient to homogenize the alloy, such time being generally about 10 to about 25 hours. The homogenized strip material is cold rolled to effect a first reduction in sheet thickness of at least 25%, and generally about 50 to 85%, heated to a recovery temperature of about 400° to 475° F. for 2 to 4 hours, and then subjected to a second cold rolling to effect a reduction in thickness of at least 10%, and generally 10 to 50%. The cold rolled sheet product is thereafter heated to effect recrystallization of the grain structure and then subjected to effect a final reduction in thickness of at least 50% of the original thickness of the sheet to impart a hard temper to the sheet.

To effect the most advantageous reduction in earing, the sheet is subjected to a second recovery heating of about 450° to about 525° F. for 0.5 to 3 hours intermediate between the second cold reduction and the recrystallization heating step.

Although the process of the copending application provides continuous strip cast aluminum alloy 3004 exhibiting non-galling and low earing characteristics, the alloy sheet when fabricated into a two piece drawn and wall-ironed can exhibits a marginal level of buckle strength, that is, the ability of the can to withstand high internal pressure without bottom inversion.

Buckle strength is determined by applying pressure within a drawn and wall-ironed can and then gradually increasing the pressure until the bottom end of the can deforms and bulges out, i.e., it buckles. The pressure at which the bottom buckles is then designated as the buckle strength. To be acceptable as can body stock a can formed from the alloy sheet must exhibit a buckle strength of at least 90 pounds per square inch (psi), and preferably between 95 and 100 psi. Cans drawn and wall-ironed from a hard temper sheet of the continuous strip cast aluminum alloy 3004 homogenized at 1050°–1100° F. to eliminate galling exhibit a buckle strength of about 85 psi. When the cold roll/recovery-recrystallization heating steps of the copending application are employed to process the homogenized alloy 3004 to low earing can stock, the buckle strength of cans formed from the stock ranges from 85 to 90 psi.

SUMMARY OF THE INVENTION

According to the present invention, there is provided a continuous strip cast aluminum alloy 3004 of one inch or less characterized by improved mechanical properties, which can be processed into sheet stock material capable of being deep drawn and wall-ironed into containers without galling and possessing the low earing and high strength properties necessary for beverage can use, the alloy 3004 having incorporated therein up to about 0.40% by weight chromium.

The alloy of the present invention has the following range of constituents expressed in percent by weight: about 0.5 to about 1.5% magnesium, about 0.5 to about 1.5% manganese, about 0.1 to about 1.0% iron, about 0.1 to about 0.5% silicon, 0.0 to about 0.25% zinc, 0.0 to about 0.25% copper, about 0.1 to about 0.4% chromium, and suitably 0.11 to about 0.25% chromium the balance being aluminum and incidental elements and impurities.

For sheet formed from the modified alloy 3004 of the present invention to perform as desired, it is essential that it be in the state resulting from a cold roll reduction of at least 50% of the material in the recrystallized state. The sheet in this state exhibits tensile yield strengths in the range of 40,000 to 45,000 psi and total elongation, measured in 2 inches gage length samples, of 1.5% or more. A tensile yield strength of 40,000 to 45,000 psi in the sheet material has been found, when such sheet is drawn and wall-ironed into a two piece beverage container, to correlate with a can buckle strength of at least 98 psi.

The improved properties imparted to alloy 3004, and particularly the high tensile yield strengths, by the incorporation therein of about 0.1 to about 0.4% by weight chromium is totally unexpected when viewed against the teachings of the prior art. Thus, in the three prior art patents previously discussed, U.S. Pat. No. 3,930,895 makes no mention of chromium as an additament to alloy 3004. U.S. Pat. No. 4,111,721 teaches that additaments to alloy 3004 such as chromium should be limited to trace amounts in the order of several hundred thousands of a weight percent or less as such additaments tend to have profound effects on the intermetallic particle sizes in the alloy. U.S. Pat. No. 3,834,900 teaches that the presence of chromium in the strip cast aluminum alloy should be minimized, i.e., limited to a concentration of less than 0.001% by weight, to avoid casting defects.

PREFERRED EMBODIMENTS

The composition and processing limits mentioned in the preceding paragraphs must be closely followed in order to achieve the required high tensile yield strength properties which characterize the sheet prepared from continuous strip cast alloy of the present inventon. It is critical to the practice of the present invention that the chromium concentration in the alloy be strictly adhered to. For exammple, if the maximum chromium concentration levels are exceeded, problems such as fracturing during can forming may result. If chromium levels of less than about 0.1% by weight are incorporated in the alloy, the tensile yield strength of sheet fabricated from the continuous strip cast alloy falls below the minimum requirements for beverage can performance.

In converting the alloy composition of the present invention into sheet material by strip casting, the aluminum and alloying elements are charged into a melting furnace from which a stream of alloy is fed to a conventional strip caster which solidifies a web of an inch or less in thickness preferably about 0.25 to 0.50 inch in thickness. The solidified web is cold rolled to effect a reduction in thickness of at least about 25%, after which it is annealed in an atmosphere controlled furnace. The annealed web is cold rolled again to effect a reduction in thickness of about 50 to 90%. Preferably, the strip cast web is fabricated into sheet having non-galling, low earing and high strength characteristics by employing the homogenization and cold roll/anneal process conditions of the aforementioned copending patent application.

Thus to affect homogenization, the continuous strip cast web is heated at about 950° to about 1150° F. and preferably about 1000 to about 1100° F. for a period of time up to about 50 hours and preferably about 10 to 25 hours.

In the event that the strip cast aluminum web is subjected to homogenization temperatures while in coil form, it is preferred that the coil be heated to the homogenization temperature in a slow, sequential manner for time periods ranging from 2 to 10 hours at increasing temperatures to avoid incipient melting of the alloy which will otherwise cause the coil layers to fuse and weld together and render the coiled product unsuitable for subsequent use. A programmed heating sequence which has been found advantageous for the homogenization of the continuous cast aluminum coil having the alloy composition of the present invention is as follows:

| |
|---|
| Temperature of the web is raised from ambient (75° F.) to 1000° F. over a 5 hour period. |
| Temperature of the web is raised from 1000 to 1050° F. over a 3 hour period. |
| Temperature of the web is raised from 1050 to 1100° F. over a 5 hour period. |
| Web is homogenized at 1100 ± 10° F. for 20 hours. |

Homogenization affects a change in the microstructure of the alloy composition of the present invention primarily in the size, shape and distribution of the intermetallic particles present in the alloy matrix. Examination of photomicrographs of the homogenized aluminum alloy composition of the present invention indicates that the secondary constituents in the aluminum alloy, e.g. (MnFeSi)Al, are caused to agglomerate whereby they change their shape substantially and increase in size. The larger the intermetallic particle size the less the degree of galling encountered during wall-ironing. The net effect of the homogenization treatment is the development of intermetallic particles approaching a globular shape having a particle size of 1 to 3 microns. These relatively large, globular shaped particles are believed to act as galling-resistant bearings for the strip cast stock during the severe mechanical working encountered in the wall-ironing operations of two piece can manufacture.

The relationship between homogenization temperature, intermetallic particle size and galling is summarized in the Table below:

TABLE

| Homogenization Temperature (°F.)* | Intermetallic Size (Microns) | Galling |
|---|---|---|
| 900–950 | 0.5–1.0 | Moderate |
| 1000–1050 | 0.7–1.2 | Marginal |
| 1090–1140 | 1.0–3.0 | None |

*20 hours @ temperature

To maintain, at a minimum, the earing levels of drawn cups formed from the alloy sheets, it is preferred that the cold roll/recovery-recrystallization heating sequence of the copending patent application be employed. It is to be noted that the increased tensile yield strength and the can buckle strength correlated to such tensile yield strength is achieved with the alloy of the present invention irrespective of whether or not this specific cold roll/recovery recrystallization sequence is utilized.

Thus, after the modified aluminum alloy 3004 web of the present invention has been produced by continuous strip casting and homogenized in accordance with the parameters disclosed above, the cooled web is subjected to a first cold rolling step to effect a total gauge reduction in excess of about 25% and preferably about 50 to about 90%. Thereafter the cold rolled sheet is heated to a "recovery temperature" level, i.e., a temperature at which the rolled metal is softened without forming a new grain structure. For the aluminum alloy of the present invention the recovery temperature is in the range of about 300° to about 550° F. The recovery temperature to which the cold rolled web may be heated after the first cold roll reduction is about 350° to about 500° F. for about 2 to about 6 hours and preferably from about 425° to about 475° F. for 2 to 4 hours.

After being heated at a recovery temperature, the heated web is cooled to ambient temperature and subjected to a second cold rolling step to effect a total reduction in thickness of the web of at least 10% and preferably between about 10 to about 50%.

After the second cold roll step, the temperature of the cold rolled web is raised to the "recrystallization temperature" level, i.e., a temperature at which the rolled metal web softens simultaneously with the formation of a completely new grain structure. In the case of the alloy of the present invention, the grain structure changes from a substantially elongated structure to an equiaxed structure when the alloy is heated at the recrystallization temperature which is in the range of about 600° to about 900° F., the heating being effected for about 1 to about 4 hours and preferably at a temperature between about 700° to about 800° F. for about 2 to about 3 hours.

After heating at the recrystallization temperature for the prescribed time period, the recrystallized web is cooled to ambient temperature and then cold rolled, e.g., to at least about 50% and preferably about 60 to about 90%, to the final gauge dictated by can performance requirements, e.g., 0.012 to 0.0145 inch and H19 temper.

To achieve an optimum reduction in earing, the aluminum web is preferably heated a second time to a recovery temperature, the second recovery heating occurring between the second cold rolling step and the recrystallization heating step. The second recovery heating is generally effected at a temperature between about 450° and 525° F. for about 0.5 to about 3 hours and most advantageously between about 475° to about 500° F. for about 0.75 to about 1.25 hours.

In effecting the second recovery heating, the web may be cooled to room temperature between the second recovery heating step and the recrystallization step. Preferably, the recrystallization heating is carried out without prior cooling to room temperature by direct heating from the second recovery temperature to the recrystallization temperature.

It has been further determined that to achieve a consistency in earing and buckle strength results it is advantageous that, after the homogenization step the web is cooled in a controlled stepped manner, i.e., at a cooling rate of no more than 75° F./hr. A preferred sequence of cooling is summarized below:

| Temperature Range of Cooling, °F. | Time to Reach Lower Temperature (Hours) | Average Cooling Rate °F./hr |
|---|---|---|
| 1100–900 | 4.0 | 50 |
| 900–750 | 2.0 | 75 |
| 750–375 | 12.5 | 30 |

A more thorough understanding of the present invention may be attained by reference to the following specific Examples of the invention.

EXAMPLE I

A strip-cast aluminum alloy having the alloy composition of the present invention designated by the symbol "I" was prepared as well as alloy compositions having varying alloy constituents within the 3004 specification range designated by the symbol "A". These alloys were then evaluated for use in the fabrication of drawn and wall-ironed can bodies. The composition of the alloys is summarized in Table I below:

TABLE I

| | Composition of Alloys (Wt. %) | | | | | |
|---|---|---|---|---|---|---|
| | Mg | Mn | Fe | Si | Zn | Cr |
| Alloy I | 1.14 | 1.12 | 0.23 | 0.28 | 0.02 | 0.11 |
| Alloy $A_1$ | 1.07 | 0.94 | 0.32 | 0.22 | 0.06 | — |
| Alloy $A_2$ | 1.10 | 1.08 | 0.22 | 0.30 | 0.02 | — |

One foot wide by three feet long sections of the cast aluminum strip having a thickness of 0.48 inch were placed in a furnace in a nitrogen atmosphere and heated for 10 to 40 hours at homogenization temperatures varying from 1094° F. to 1112° F. The heating and cooling conditions that would be expected to occur in a commercially produced 10–15 ton coil of a strip of continuous cast aluminum alloy of about 0.50 inch thickness when subjected to the programmed heating and cooling sequences preferred for homogenization and outlined in the Preferred Embodiments section of this application (pages 7 and 10) were simulated to achieve strip homogenization. The time and temperature used in the heat and cooling sequences are summarized in Table II below:

TABLE II

| SIMULATED COIL HOMOGENIZATION CONDITIONS | | | |
|---|---|---|---|
| HOMO-GENIZATION | TEMP | TIME AT TO 375° F. | COOLING TIME |
| A | 1112 | 35 | 35 |
| B | 1094 | 40 | 40 |
| C | 1094 | 10 | 20 |

The strips homogenized in accordance with the conditions in Table II were then cooled in accordance with the following schedule:

| Temperature Drop (°F.) | Time to Reach Lower Temperature Hours |
|---|---|
| 1130 to 1100 | 0.6 |
| 1100 to 900 | 4.0 |
| 900 to 750 | 2.0 |
| 750 to 375 | 12.5 |

At 375° F. the furnace was shut off and the strips allowed to cool to room temperature.

The cooled strips were rolled in successive passes using a commercial rolling mill until the strip was reduced to varying degrees of thickness ranging from 66 to 75% (0.160 to 0.120 inch).

In a first series of cold roll/recovery-recrystallization heatings the reduced (66–72%) thickness strips were subjected to a first recovery temperature wherein the strips were heated in a furnace to 450° F. and held for 3 hours. After being subjected to the first cold roll/recovery temperature treatment, the strips were then subjected to a second cold roll reduction by being passed successively through a pair of reduction rolls until the strip was reduced 10–25% in thickness (to 0.120 inch).

After the second cold roll reduction the strips were subjected to a second recovery heating at 500° F. for one hour and then heated to recrystallization temperature of 800° F. for 2 hours.

The first series of cold roll/recovery-recrystallization heatings was varied whereby in a first variation the second cold reduction was eliminated and recrystallization carried out immediately after the first recovery heating. In a second variation, the recovery heating was eliminated and recrystallization was carried out immediately after the cold reduction.

The cold roll/anneal conditions to which the series of strips were subjected are summarized in Table III below.

TABLE III

| COLD ROLL/ ANNEAL CYCLE | 1st COLD REDUCTION (% Red.) | COLD ROLL/ANNEAL CONDITIONS: 1st RECOVERY HEATING Temp (°F.) | 1st RECOVERY HEATING Time @ Temp (Hrs) | 1st RECRYST. HEATING Temp (°F.) | 1st RECRYST. HEATING Time @ Temp (Hrs) | 2nd COLD REDUCTION (% Red.) | 2nd RECOVERY HEATING Temp (°F.) | 2nd RECOVERY HEATING Time @ Temp (Hrs) | 2nd RECRYST HEATING Temp (°F.) | 2nd RECRYST HEATING Time |
|---|---|---|---|---|---|---|---|---|---|---|
| 1 | 72 | 450 | 3 | None | | 10 | 500 | 1 | 800 | 2 |
| 2 | 66 | 450 | 3 | None | | 25 | 500 | 1 | 800 | 2 |
| 3 | 75 | 400 | 4 | 800 | 2 | NONE | NONE | | NONE | |
| 4 | 66 | 500 | 1 | 800 | 2 | 25 | 500 | 1 | 800 | 2 |
| 5 | 75 | NONE | | 800 | 3 | NONE | NONE | | NONE | |

The heating and cooling conditions that would be expected to occur in processing a commercial coil were used in each recovery and recrystallization step. These conditions are summarized in Table IV below:

TABLE IV

| COLD ROLL/ ANNEAL CYCLE | TIME TO REACH 1st RECOVERY TEMP. (HRS) | TIME TO COOL TO 75° F. (HRS) | COIL SIMULATION HEATING/COOLING CONDITIONS: TIME TO HEAT TO 1st RECRYST. TEMP. (HRS) | TIME TO COOL TO 375° F. (HRS) | TIME TO REACH 2ND RECOVERY TEMP. (HRS) | TIME TO HEAT TO 2ND RECRYST. TEMP. (HRS) | TIME TO COOL TO 375° F. (HRS) |
|---|---|---|---|---|---|---|---|
| 1 | 4 | 6 | — | — | 5 | 4 | 11 |
| 2 | 4 | 6 | — | — | 5 | 4 | 11 |
| 3 | 5 | — | 4 | 10 | 5 | — | — |
| 4 | 5 | — | 4 | 5 | 5 | 4 | 11 |
| 5 | — | — | 7 | 10 | — | — | — |

The recrystallized strips were cooled to room temperature and then were hardened by passing the strips successively in a commercial rolling mill until the strip was reduced about 88% in thickness (H19 temper) to 0.0133 to 0.0148 inch.

The H19 tempered strips were examined under a scanning electron microscope in the back scattering mode and found to have an intermetallic particle size in the 1 to 3 microns range, indicating that no galling would occur when the strips were subjected to the wall-ironing conditions of can making.

To determine the level of earing that would occur when the strips were subjected to the drawing operations of can making, circular blanks 2.20 inch diameter were cut from the H19 hardened strips and deep drawn into shallow cups of 1.32 inch diameter with a resultant 39% reduction in diameter. The tooling used for deep drawing was designed to yield about a 3.5% positive clearance (0.0005 inch) between the walls of the punch and die. A die clearance of 5% or less and reduction in diameter of 39% is typically required in this standard test for earing which simulates the drawing step of the can making process. Cupping speed and blank clamping pressure were adjusted for each test to obtain a fracture and wrinkle-free cup.

The results of the earing tests using strips of the alloy compositions of Table I which had been subjected to the homogenization and cold roll/anneal conditions disclosed in Tables II and III are summarized in Tables V–VII below. Each earing test result represents an average of three tests.

The mechanical properties of the H19 hardened strips in tension, i.e. yield strength, ultimate strength and tensile total elongation were determined in accordance with the ASTM Test Procedure Number E-8 using 2 inches gage length test specimens. Each mechanical test result represents an average of six tests, three measured in the direction longitudinal and three in transverse to the rolling direction. The results of these tests are also recorded in Tables V–VII below.

It has been previously determined that the buckle strength of cans formed from continuous strip cast aluminum alloy 3004 correlates closely with the tensile yield strength of the H19 temper sheet. The correlation between buckle strength and tensile yield strength is summarized in Table VIII below.

The tensile ultimate strength, along with the tensile total elongation, is a measure of sheet formability. To be suitable for can body manufacture, the sheet must have a tensile ultimate strength of at least 42,000 psi.

Tensile total elongation measured in percent is a measure of ductility. To be suitable for can body manufacture the sheet must have a tensile total elongation of at least 1.5%.

TABLE V

EARING/MECHANICAL TESTS ALLOY

| Homogenization Condition | Cold Roll/ Anneal Cycle | Earing % | Mechanical Tests (In Tension): Yield Strength psi, $10^3$ | Ultimate Strength psi, $10^3$ | Total Elongation % |
|---|---|---|---|---|---|
| C | 1 | 3.12 | 42.3 | 44.5 | 2.3 |
| B | 2 | 4.33 | 41.1 | 43.2 | 2.2 |
| C | 2 | 3.36 | 41.7 | 44.2 | 2.2 |
| B | 3 | 4.20 | 40.7 | 42.3 | 2.3 |
| C | 3 | 3.76 | 42.1 | 44.7 | 2.5 |
| A | 4 | 3.98 | 40.0 | 41.8 | 2.3 |
| C | 5 | 4.59 | 42.7 | 45.5 | 2.3 |

TABLE VI

EARING/MECHANICAL TESTS ALLOY A1

| Homogenization Condition | Cold Roll/ Anneal Cycle | Earing % | Mechanical Tests (In Tension): Yield Strength psi, $10^3$ | Ultimate Strength psi, $10^3$ | Total Elongation % |
|---|---|---|---|---|---|
| C | 1 | 3.12 | 40.6 | 43.8 | 2.4 |
| B | 2 | 4.81 | 38.0 | 39.8 | 2.2 |
| C | 2 | 4.28 | 40.1 | 42.4 | 2.2 |
| B | 3 | 4.36 | 39.2 | 41.0 | 2.4 |
| A | 4 | 3.98 | 38.5 | 40.8 | 2.3 |
| B | 5 | 4.66 | 39.5 | 41.5 | 2.1 |

TABLE VII

EARING/MECHANICAL TESTS ALLOY A2

| Homogenization Condition | Cold Roll/ Anneal Cycle | Earing % | Mechanical: Yield Strength psi, $10^3$ | Ultimate Strength psi, $10^3$ | Total Elongation % |
|---|---|---|---|---|---|
| B | 2 | 4.65 | 36.4 | 38.4 | 2.1 |
| C | 2 | 4.24 | 39.5 | 42.0 | 2.1 |
| B | 3 | 5.74 | 35.4 | 37.5 | 1.9 |
| C | 3 | 4.14 | 38.9 | 42.8 | 2.0 |
| A | 4 | 4.40 | 37.1 | 39.0 | 2.1 |
| B | 5 | 5.99 | 39.0 | 41.2 | 2.0 |

TABLE VIII

TENSILE YIELD STRENGTH/BUCKLE STRENGTH CORRELATION IN CAN BODY STOCK ALLOY 3004-H19 PREPARED FROM CONTINUOUS STRIP CAST WEB

| Tensile Yield Strength* (psi, $10^3$) | Buckle Strength** (psi) |
|---|---|
| 36.3 | 83.7 |
| 36.8 | 85.2 |
| 37.4 | 88.5 |
| 37.8 | 90.9 |
| 38.2 | 89.5 |
| 38.7 | 92.5 |
| 39.6 | 94.0 |
| 39.8 | 97.0 |

TABLE VIII-continued

| TENSILE YIELD STRENGTH/BUCKLE STRENGTH CORRELATION IN CAN BODY STOCK ALLOY 3004-H19 PREPARED FROM CONTINUOUS STRIP CAST WEB | |
|---|---|
| Tensile Yield Strength* (psi, $10^3$) | Buckle Strength** (psi) |
| 40.5 | 98.5 |
| 40.6 | 99.0 |
| 41.3 | 100.0 |
| 42.7 | 101.0 |
| 42.5 | 102.0 |

*Average of six tests, three for longitudinal and three for transverse samples with respect to the rolling direction.
**Buckle strength measured for 0.0135 "sheet thickness, or adjusted for gage at the rate of 1 psi for 0.0001" variation.

By reference to Table V, it is immediately apparent that the incorporation of 0.11% by weight chromium in aluminum alloy 3004 improves the tensile yield strength and thereby the corresponding buckle strength without any deleterious effect on the can formability of sheet formed from the alloy. Thus the tensile yield strength of Alloy I generally exceeds 40,000 psi reflecting a buckle strength in excess of 98 psi. Similarly, the tensile ultimate strength of Alloy I is in excess of the minimum requirement of 1.5%.

By comparing the data recorded in Tables VI and VII with that of Table V, it is immediately apparent that conventional 3004 alloy, such as alloys $A_1$ and $A_2$, when processed in accordance with the same conditions of Alloy I have buckle strength substantially lower than that of Alloy I.

EXAMPLE II

A second series of strip cast aluminum alloys were evaluated for use in the fabrication of drawn and wall ironed can bodies. The composition of the alloys is summarized in Table IX below:

TABLE IX

| | Composition of Alloys (wt. %) | | | | | | |
|---|---|---|---|---|---|---|---|
| | Mg | Mn | Fe | Si | Zn | Cr | Cu |
| Alloy A | 1.13 | 1.15 | 0.46 | 0.17 | 0.07 | 0.26 | 0.15 |
| Alloy B | 0.90 | 0.96 | 0.35 | 0.13 | 0.06 | 0.25 | 0.15 |
| Alloy C | 1.05 | 1.03 | 0.49 | 0.19 | 0.07 | 0.20 | 0.15 |

The work hardened coils were then fabricated into two-piece aluminum beverage cans on a commercial draw and wall iron manufacturing line, about 5000 cans being fabricated from each coil. No galling was encountered. Earing ranged from 2.0 to 2.6%.

The cans were also evaluated for buckle strength, i.e., ability of the can to withstand high internal pressure without bottom inversion.

Buckle strength is determined by applying pressure within a drawn and wall-ironed can and then gradually increasing the pressure until the bottom end of the can deforms and bulges out, i.e., it buckles. The pressure at which the bottom buckles is then designated as the buckle strength. To be acceptable as can body stock, a trimmed can formed from the alloy sheet must exhibit a buckle strength of at least 90 pounds per square inch (psi), preferably between 95 and 100 psi.

The average buckle strength for cans fabricated from alloys A, B and C in the above manner are recorded in the Table X below:

TABLE X

| Alloy | Buckle Strength (psi) |
|---|---|
| A | 98 |
| B | 91 |
| C | 100 |

What is claimed is:

1. A process for improving the mechanical characteristics of continuous strip cast Aluminum Association Alloy 3004 in sheet form which comprises providing the alloy composition comprised of about 0.5 to about 1.5% by weight magnesium, about 0.5 to 1.5% by weight manganese, about 0.1 to about 1.0% by weight iron, about 0.1 to about 0.5% by weight silicon, about 0.0 to about 0.25% by weight zinc, about 0.0 to about 0.25% by weight copper, the balance being aluminum, incorporating in the alloy composition about 0.10 to about 0.4% by weight chromium, continuously casting the aluminum alloy in strip form having a thickness up to one inch, homogenizing the strip at a temperature of about 950° to about 1150° F. for up to 50 hours, cold rolling the homogenized strip by at least 25% reduction in thickness, heating the cold rolled strip to a recrystallization temperature of between about 600° and about 900° F. and then, cold rolling the recrystallized strip to a final gage having a total reduction in thickness of at least about 50%.

2. The process of claim 1 wherein the strip is homogenized at a temperature between about 1000° and about 1100° F. for up to 25 hours.

3. The process of claim 1 wherein the cold rolled strip is heated prior to recrystallization to a recovery temperature of between about 300° and about 550° F. for about 2 to about 6 hours and then, cold rolled to a second reduction in thickness of at least 10%.

4. The process of claim 1 wherein the first cold roll reduction effects a reduction in thickness of about 50 to about 90%.

5. The process of claim 1 wherein the cold rolled strip is heated prior to recrystallization at a recovery temperature of about 425° to about 475° F. for about 2 to about 4 hours.

6. The process of claim 1 wherein the cold rolled strip is heated to a recrystallization temperature between about 700° to about 800° F. for about 2 to about 3 hours.

7. The process of claim 3 wherein the second cold roll reduction effects a reduction in thickness of about 10 to 50%.

8. The process of claim 3 wherein the strip is heated to a second recovery temperature after the second cold roll and prior to heating the strip to the recrystallization temperature, the second recovery temperature being in the range of about 450° to about 525° F., the heating being effected for about 0.5 to about 3 hours.

9. The process of claim 1 wherein the recrystallized strip is cold rolled to a final gauge having a total reduction in thickness of about 50 to about 90%.

10. The process of claim 1 wherein the continuous cast aluminum strip has a thickness of between about 0.25 inch and about 0.50 inch.

11. The process of claim 1 wherein the chromium incorporated in the alloy 3004 is in the range of about 0.11 to about 0.25%.

12. A sheet prepared by the process of claim 1.

13. An aluminum alloy sheet fabricated from a continuous strip cast aluminum alloy having a thickness of up to one inch, said sheet having a thickness of 0.008 to 0.017 inch that has received a reduction in thickness of at least 50% by cold rolling to provide a hard temper, the alloy being comprised of about 0.5 to about 1.5% by weight magnesium, about 0.5 to 1.5% by weight manganese, about 0.1 to about 1.0% by weight iron, about 0.1 to about 0.5% by weight silicon, about 0.0 to about 0.25% by weight zinc, about 0.0 to about 0.25% by weight copper and about 0.1 to about 0.4% by weight chromium the balance being aluminum.

14. The aluminum alloy sheet of claim 13 being characterized in the hard condition by a tensile yield strength of at least 40,000 psi, a tensile ultimate strength of at least 42,000 psi and a tensile total elongation of at least 1.5%.

* * * * *